US006068544A

United States Patent [19]

Chiu et al.

[11] Patent Number: 6,068,544

[45] Date of Patent: May 30, 2000

[54] APPARATUS AND METHOD FOR CALIBRATING A POLISHING HEAD

[75] Inventors: Chen-Chia Chiu, Tainan; Fang-Lin Lu, Taipei; Kuo-Pao Yeh, Hsin-chu; Yu-Sheng Shen, Taipei, all of Taiwan

[73] Assignee: Taiwan Semiconductor Manufacturing Co., Ltd., Hsin-Chu, Taiwan

[21] Appl. No.: 09/323,343

[22] Filed: Jun. 1, 1999

[51] Int. Cl.[7] ..... B24B 7/00

[52] U.S. Cl. ..... 451/67; 451/442

[58] Field of Search ..... 451/28, 67, 442; 33/644, 645

[56] References Cited

U.S. PATENT DOCUMENTS

| | | | |
|---|---|---|---|
| 3,741,567 | 6/1973 | Bis | 274/10 S |
| 4,447,956 | 5/1984 | Chung | 33/172 D |
| 4,659,094 | 4/1987 | Leonov | 279/1 L |
| 5,549,502 | 8/1996 | Tanaka et al. | 451/8 |

*Primary Examiner*—Timothy V. Eley
*Assistant Examiner*—Dung Van Nguyen
*Attorney, Agent, or Firm*—Tung & Associates

[57] ABSTRACT

An apparatus for calibrating the centering of polishing heads in a polishing machine that is equipped with a plurality of spindles onto which polishing heads are mounted and a method for using such apparatus are disclosed. In the apparatus, a calibration disc is provided which has a hollow shaft mounted at a center of the bottom surface of the disc. A centering pin slidingly engaging an elongated cavity in the hollow shaft such that its protruded tip portion may be adjusted by using a locking device such as a set screw for different calibration procedures. The present invention novel apparatus can be used to calibrate the positioning of a polishing head mounted in a spindle with a pedestal in a load cup that is equipped with a center alignment aperture. The calibration can be conducted not only in the X, Y direction (or in the circumferential direction) of the spindle movement, but also in the Z direction (or a sweep direction) of the traversing spindle that occurs during a polishing operation.

20 Claims, 6 Drawing Sheets

APPARATUS AND METHOD FOR CALIBRATING A POLISHING HEAD

FIELD OF THE INVENTION

The present invention generally relates to an apparatus and a method for calibrating a polishing head used in a polishing machine for electronic substrates and more particularly, relates to an apparatus and a method for calibrating the centering of polishing heads in a chemical mechanical polishing (CMP) machine that is equipped with a plurality of spindles for mounting the polishing heads.

BACKGROUND OF THE INVENTION

Apparatus for polishing thin, flat semiconductor wafers is well known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is formed downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing apparatus has been employed in combination with a pneumatically actuated polishing head. CMP apparatus is used primarily for polishing the front face or device side of a semiconductor wafer during the fabrication of semiconductor devises on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus is shown in FIG. 1A. The CMP apparatus 10 consists of a controlled mini-environment 12 and a control panel section 14. In the controlled mini-environment 12, typically four spindles 16, 18, 20, and 22 are provided (the fourth spindle 22 is not shown in FIG. 1A) which are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disc 30 rotated by a motor (not shown) in a direction opposite to the rotational direction of the polishing head 26.

Also shown in FIG. 1A is a conditioner arm 32 which is equipped with a rotating conditioner disc 34. The conditioner arm 32 pivots on its base 36 for conditioning the polishing pad 38 for the in-situ conditioning of the pad during polishing. While three stations each equipped with a polishing pad 28, 38 and 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e., over the polishing pad 28. Simultaneously, a polished wafer mounted on spindle 20 is moved into the head clean load/unload station for unloading.

A cross-sectional view of a polishing station 42 is shown in FIGS. 1B and 1C. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

An enlarged cross-sectional representation of the polishing action which results from a combination of chemical and mechanical effects is shown in FIG. 1C. The CMP method can be used to provide a planner surface on dielectric layers, on deep and shallow trenches that are filled with polysilicon or oxide, and on various metal films. A possible mechanism for the CMP process involves the formation of a chemically altered layer at the surface of the material being polished. The layer is mechanically removed from the underlying bulk material. An outer layer is than regrown on the surface while the process is repeated again. For instance, in metal polishing, a metal oxide layer can be formed and removed repeatedly.

Referring now to FIG. 2A, wherein a conventional carousel 50 (or a cross member) for a CMP machine is shown. In carousel 50, four spindle mounts 52,54,56 and 58 are provided in 90° intervals. As illustrated by spindle mount 56, a traversing platform 60 is sued for mounting a spindle (not shown) thereto. The spindle is in turn connected to a polishing head (not shown) for the mounting of a substrate to be polished. It should be noted that carousel 50 is shown in FIG. 2A in an upside-down position. The mounting platform 60 is controlled by motor 62 for traversing on track 64 during a polishing operation. The traversing action of the mounting platform 60 relative to the polishing head (not shown) facilitates an uniform polishing operation on the substrate surface.

Each of the spindle mounts 52,54,56 and 58 must be calibrated prior to the start of a series of CMP processes. They must also be calibrated after each preventive maintenance service during which the polishing head spindle may have been removed. The calibration can be conducted in a load cup 66 shown in FIG. 2B. The load cup 66, also known as a head clean/load/unload station or HCLU, is used for performing major functions of loading, unloading wafers onto, from a polishing head. In a typical CMP apparatus such as one manufactured by Applied Materials, Inc. of Santa Clara, Calif., a single HCLU station is utilized in conjunction with three polishing discs (not shown) which are each equipped with a polishing pad for performing the CMP operation. A wafer is first loaded into the HCLU station 66 and then the carousel 50 turns 90°, 180° and 270° sequentially to perform successive polishing operations on the wafer by the three polishing pads which may be provided in different roughness. At the center of the loading platform 68, an aperture 70 is provided for calibration purpose. Each of the spindle mounted on the spindle mounts 52,54,56 and 58 must be successively calibrated to the load cup 66 prior to the start of a CMP process. During the calibration, a home position is first selected with X, Y parameters stored in a process controller. When a polishing head is loaded with a wafer for carrying out the polishing process, the head must be accurately positioned at the center of the load cup 66 or at the center of any polishing discs (not shown). If the centering is not accurately calibrated, a loading failure occurs which may incorrectly positioned wafer lead to and wafer breakage.

For each of the spindle, a two-step calibration process is required. First, the carousel is rotated 90° each time to calibrate the spindle position in the circumferential direction for its centering in the load cup. After the position in the circumferential direction is calibrated, the traversing platform 60 must also be calibrated in the sweep (or linear) direction, or in the radial direction to center the spindle. The calibration process is difficult and cannot be performed each time with high accuracy.

It is therefore an object of the present invention to provide an apparatus for calibrating the centering of polishing heads in a polishing machine that does not have the drawbacks or shortcomings of the conventional calibration apparatus.

It is another object of the present invention to provide an apparatus for calibrating the centering of polishing heads in a polishing machine equipped with a plurality of spindles for mounting of the polishing heads.

It is a further object of the present invention to provide an apparatus for calibrating the centering of polishing heads in a polishing machine wherein the apparatus is a calibration disk equipped with a calibration pin at its center for alignment with a center aperture in a load cup.

It is another further object of the present invention to provide an apparatus for calibrating the centering of polishing heads in a polishing machine which is equipped with a plurality of spindles for mounting the polishing heads thereto wherein the apparatus is capable of performing calibration in both the circumferential and in the radial direction.

It is still another object of the present invention to provide an apparatus for calibrating the centering of polishing heads in a polishing machine that consists of a calibration disc equipped with a center pin adapted for alignment with a center aperture in a pedestal and a mounting means for mounting the calibration disc to a spindle.

It is yet another object of the present invention to provide an apparatus for calibrating the centering of polishing heads which includes a hollow shaft, a pin that slidingly engaging an elongated cavity in the hollow shaft and a locking device for locking the position of the pin.

It is still another further object of the present invention to provide a method for calibrating the centering of polishing heads in a polishing machine equipped with a plurality of spindles for mounting the polishing heads by utilizing a calibration disc that is equipped with a center pin for alignment with a center aperture in a pedestal.

It is yet another further object of the present invention to provide a method for calibrating the centering of polishing heads in a chemical mechanical polishing machine that is equipped with four spindles for mounting the polishing heads by calibrating the spindles in both the circumferential direction and the radial direction.

SUMMARY OF THE INVENTION

In accordance with the present invention, an apparatus and a method for calibrating the centering of polishing heads in a polishing machine equipped with a plurality of spindles for mounting the polishing heads are provided.

In a preferred embodiment, an apparatus for calibrating the centering of polishing heads in a polishing machine equipped with a plurality of spindles for mounting the polishing heads is provided which includes a calibration disc having top and bottom parallel planar surfaces, the bottom surface is equipped with a pin at its center projecting away from and perpendicular to the planar bottom surface, the center pin is adapted for aligning a spindle on which the calibration disc is mounted to with a center alignment aperture in a pedestal generally positioned below the spindle, and a mounting means for removably mounting the calibration disc to the spindle with the center pin pointed downwardly.

In the apparatus for calibrating centering of polishing heads in a polishing machine, the pin at the center of the bottom surface may further include a hollow shaft that has an elongated cavity therein for sliding engagement with a pin through an open end of the elongated cavity, the hollow shaft has external male threads at one end for engaging an apertures having matching female threads at a center of the bottom surface, a pin for sliding engagement with the elongated cavity in the hollow shaft such that the pin extends out of or retracts into the hollow shaft, and a locking means for locking position of the pin in the elongated cavity. The mounting means for mounting the calibration disc to one of the plurality of spindles may further include locating means for the disc and the spindle. The mounting means may further include at least one C-clamp for clamping the disc to one of the plurality of spindles. The calibration disc may be in a circular shape or in a square shape. The pin may be adapted for aligning a spindle on which the calibration disc is mounted with a center alignment aperture in a pedestal for loading/unloading a substrate to be polished.

The present invention is further directed to a method for calibrating the centering of polishing heads in a polishing machine that is equipped with a plurality of spindles for mounting the polishing heads which includes the operating steps of providing a calibration disc that has top and bottom parallel planar surfaces, the bottom surface is equipped with a pin at its center projecting away from and perpendicular to the planar bottom surface, the center pin is adapted for aligning a spindle on which the calibration disc is mounted with a center alignment aperture in a pedestal that is generally positioned below the spindle, mounting a calibration disc to a spindle with the center pin pointing downwardly, positioning the spindle over the pedestal below the spindle, aligning the center pin on the calibration disc to the center alignment aperture in the pedestal, and adjusting X and Y axis of the spindle until the center pin on the calibration disc coincides with the center alignment aperture in the pedestal.

In the method for calibrating the centering of polishing heads in a polishing machine that is equipped with a plurality of spindles for mounting the polishing heads, the step of providing a pin at the center of the top surface may further include the steps of providing a hollow shaft that has an elongated cavity therein for sliding engagement with a pin through an open end of the elongated cavity, the hollow shaft has external male threads at one end for engaging an aperture that has matching female threads at a center of the bottom surface, providing a pin for sliding engagement with the elongated cavity in the hollow shaft such that the pin extends out of or retracts into the hollow shaft, and providing a locking means for locking the position of the pin in the elongated cavity. The step of providing the mounting means may further include providing a locating means for the precise positioning of the calibration disc to one of the plurality of spindles, and providing a C-clamp for clamping the disc to one of the plurality of spindles.

The method for calibrating the centering of polishing heads in a polishing machine may further include the step of providing the calibration disc in a circular shape, the step of providing four spindles for the plurality of spindles and rotating 90° such that a second spindle can be calibrated by the same steps. The method may be utilized for calibrating the centering of polishing heads in a chemical mechanical polishing machine. The method may further include the step of locking the pin at a length sufficient to penetrate the center alignment aperture in the pedestal.

In an alternate embodiment, an apparatus for calibrating the centering of polishing heads in a chemical mechanical polishing (CMP) machine that is equipped with a plurality of spindles for mounting the polishing heads is provided with includes a circular disc that has top and bottom parallel planar surfaces, a hollow shaft that has an elongated cavity therein for slidingly engaging a pin through an open end of the cavity, the hollow shaft may have external male threads at one end for engaging female threads in a center aperture on the bottom surface of the disc, a pin for slidingly engaging the elongated cavity in the hollow shaft such that the pin extends out of or retracts into the hollow shaft, and a locking means for locking position of the pin in the elongated cavity.

In the apparatus for calibrating the centering of polishing heads in a CMP machine, the plurality of spindles may include four spindles. The pin that is adapted for penetrating a center alignment aperture in a pedestal position under the spindle such that the X, Y parameters of the spindles may be adjusted for calibrating the centering. The apparatus may further include a mounting means for removably mounting the circular disc to the spindle with the center pin pointed downwardly. The mounting means may further include a locating means for aligning the circular disc to the spindle, and a clamping means for removably mounting the circular disc to the spindle. The pin may be adapted for penetrating a center alignment aperture in a pedestal position under the spindle for loading/unloading a substrate polished.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus for calibrating the centering of polishing heads in a polishing apparatus such as a chemical mechanical polishing machine that is equipped with a plurality of spindles mounted in a carousel for installing the polishing heads thereto. In the apparatus, a calibration disc is first provided which has top and bottom parallel planar surfaces with a pin mounted at a center of the bottom surface projecting away from and perpendicular to the surface, the center pin is adapted for aligning a spindle on which the disc is mounted with a center alignment aperture in a pedestal (or a load cup) that is generally positioned below the spindle. The present invention calibration apparatus may further include a mounting device for removably mounting a calibration disc to a spindle with the center pin pointed downwardly.

In a preferred embodiment, the center pin at the bottom surface of the calibration disc may be constructed in a hollow shaft which has an elongated cavity therein for slidingly engaging a pin through an open end of the cavity, the hollow shaft is equipped with male threads at one end for engaging an aperture that is threaded at a center of the bottom surface of the calibration disc. A centering pin slidingly engaging the elongated cavity in the hollow shaft such that it extends out or retracts into the shaft. The position of the pin may be locked by a locking device. The mounting means used for removably mounting the calibration disc to the spindle may include at least one C-clamp for clamping the disc to the spindle. The mounting means may further include locating means to assist in the accurate positioning of the calibration disc onto the spindle before it is locked in position by the C-clamp.

The present invention further discloses a method for calibrating the centering of polishing heads in a chemical mechanical polishing machine which is equipped with a plurality of spindles, i.e., four spindles for mounting the polishing heads thereto. In the method, a calibration disc such as that described above is first provided, the calibration disc is then mounted to a spindle with the center pin pointing downwardly, the spindle with the calibration disc mounted thereon is then positioned over a pedestal in a load cup below the spindle. The center pin on the calibration disc is aligned to the center alignment aperture in the pedestal by adjusting X and Y axis of the spindle until the center pin coincides with the center alignment aperture in the pedestal.

It should be noted that while in the preferred embodiment, a chemical mechanical polishing machine that is equipped with four spindles mounted on a carousel is illustrated, the present invention apparatus of a calibration disc and a method for using such calibration disc may be used on any spindles for mounting polishing heads in any type of polishing machine.

Figure 1A:
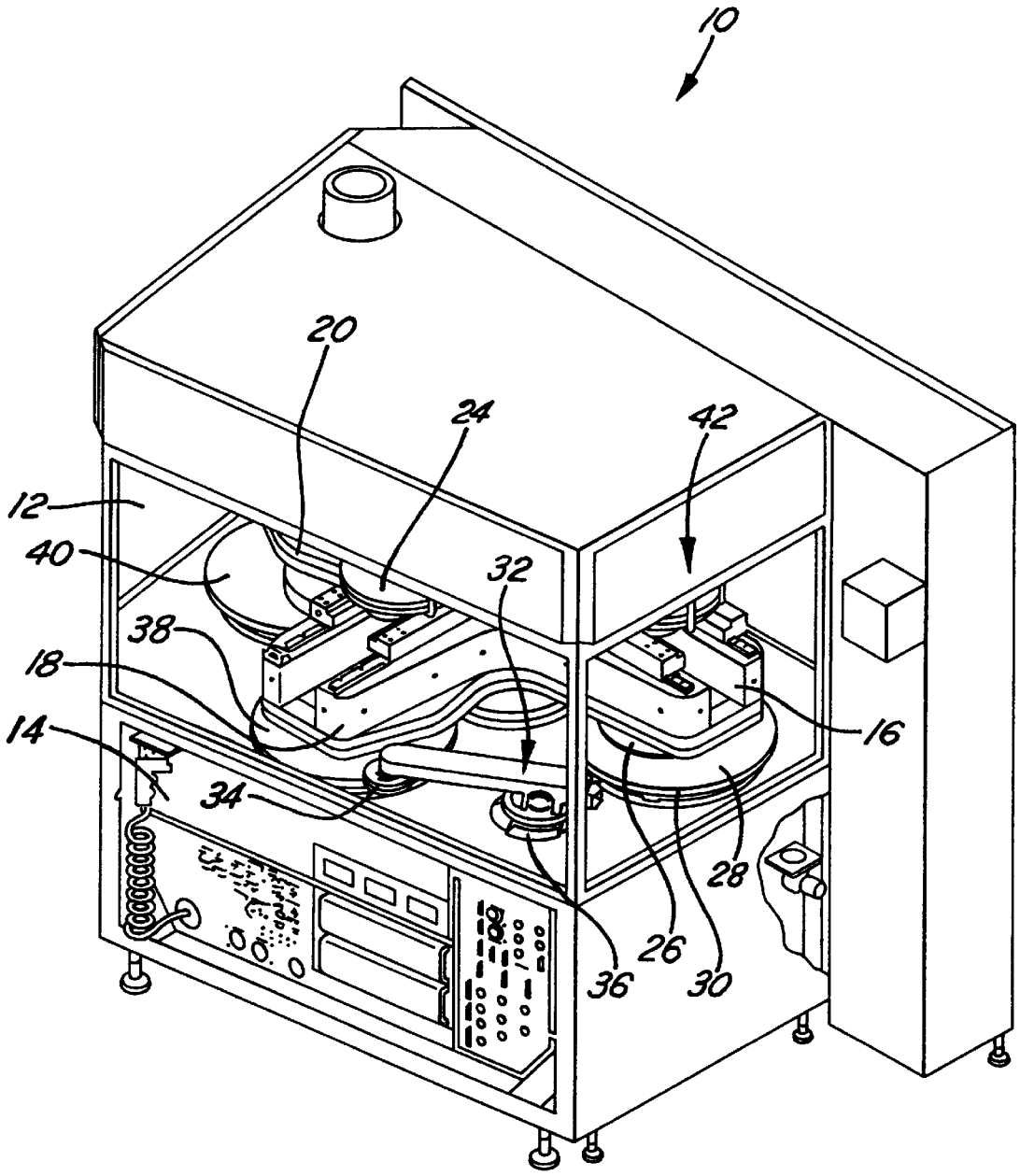
(PRIOR ART) FIG. 1A
FIG. 1A is a perspective view of a conventional chemical mechanical polishing apparatus showing a carousel with four spindles mounted thereto.
Figure 1B:
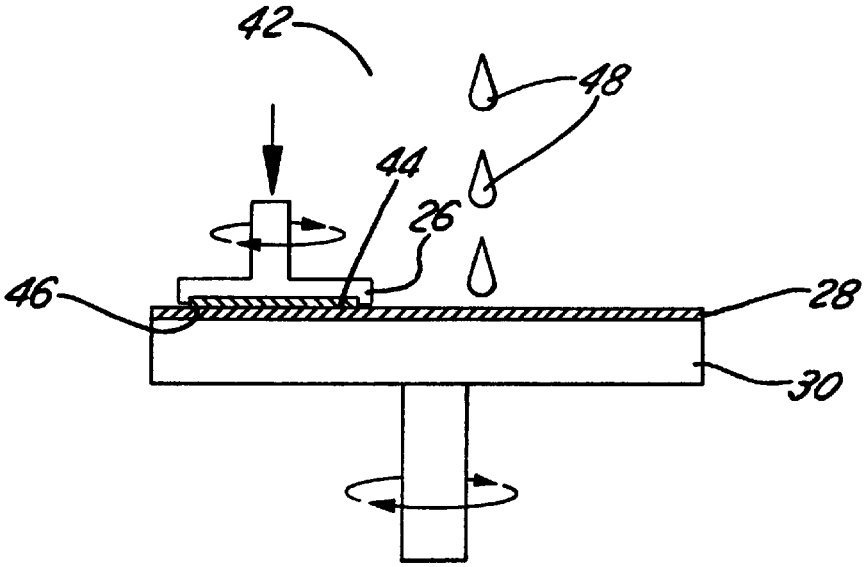
(PRIOR ART) FIG. 1B
FIG. 1B is a cross-sectional view illustrating the engagement of a polishing head on a polishing disc.
Figure 1C:
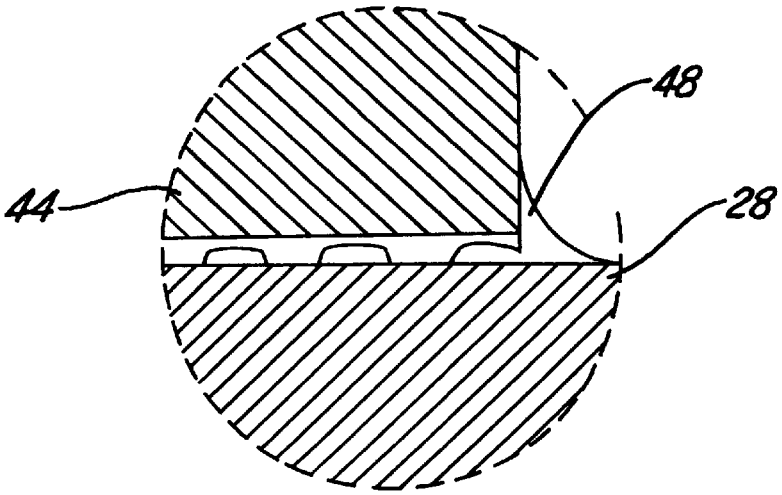
(PRIOR ART) FIG. 1C
FIG. 1C is an enlarged, cross-sectional view illustrating the interaction of slurry between a wafer surface and a polishing pad surface.
Figure 2B:
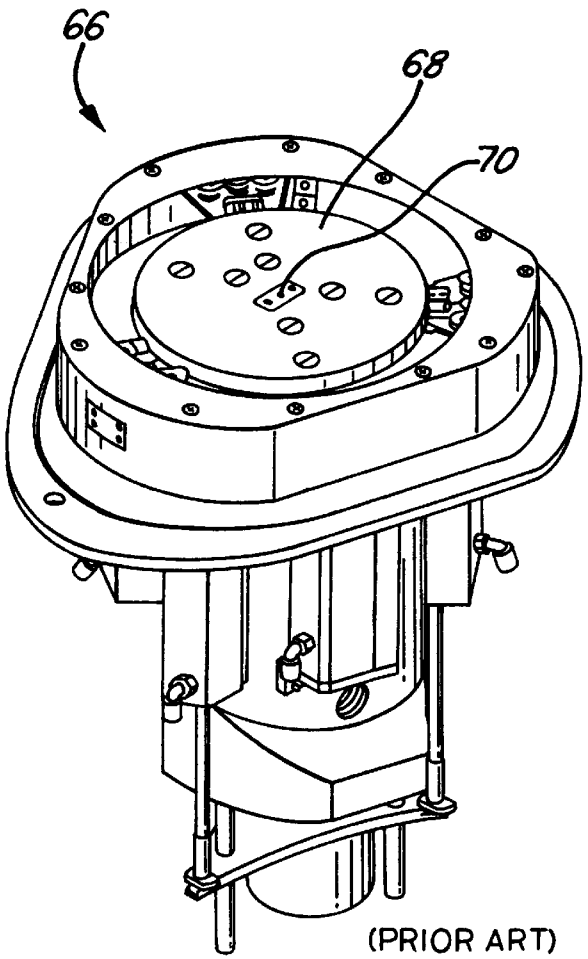
(PRIOR ART) FIG. 2B
FIG. 2B is a perspective view of a load cup and a pedestal for a conventional chemical mechanical polishing machine.
Figure 2A:
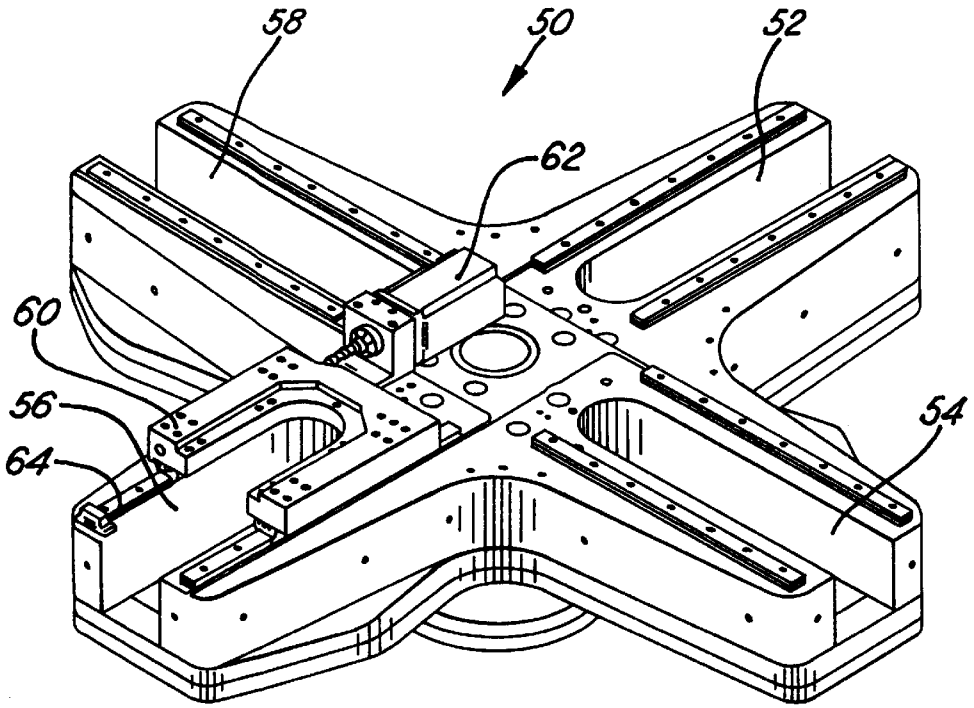
(PRIOR ART) FIG. 2A
FIG. 2A is a perspective view of a carousel for a conventional chemical mechanical polishing machine.
Figure 3B:
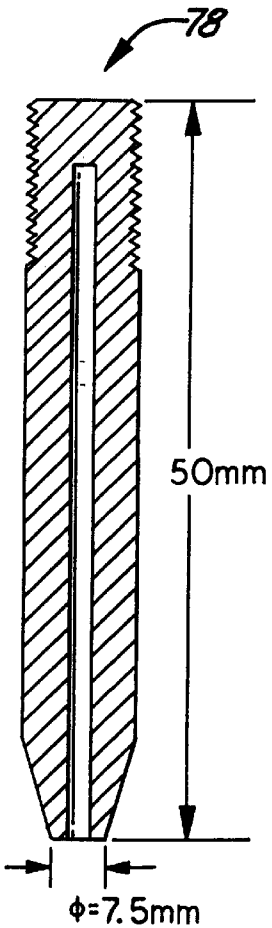
FIG. 3B is a cross-sectional view of the hollow shaft of FIG. 3.
Figure 3A:
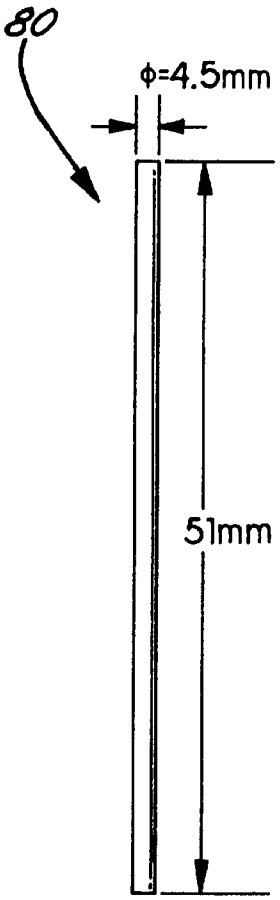
FIG. 3A is a side view of the centering pin of FIG. 3.
Figure 3:
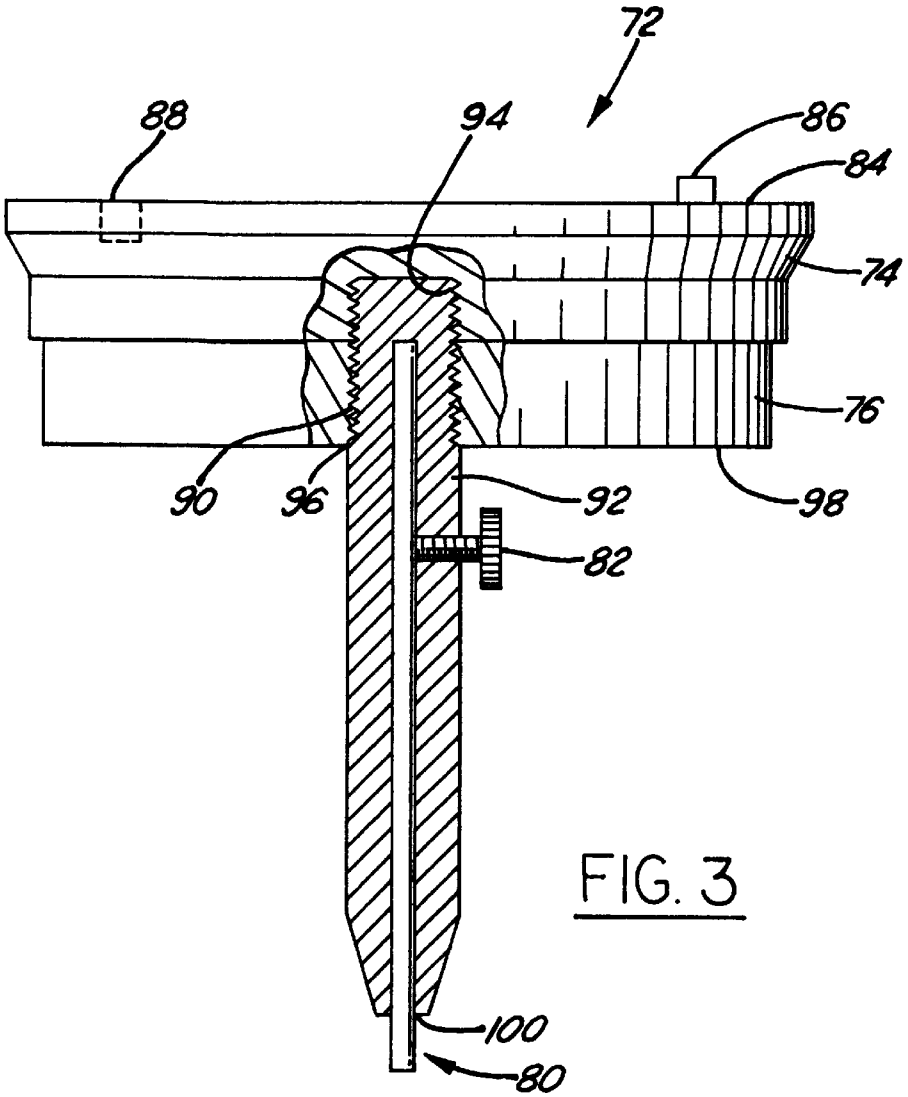
FIG. 3 is a cross-sectional view of a present invention calibration disc equipped with a center hollow shaft, a pin and a locking device.

Referring now to FIG. 3, wherein a present invention calibration disc 72 is shown. The calibration disc is constructed of a base portion 74, a top portion 76, a hollow shaft 78, a centering pin 80 and a locking device 82. On the top surface 84 of the base portion 74, a locating pin 86 and a locating aperture 88 are further provided. A corresponding locating pin 120 and a locating aperture 122 on a mounting disc 130 that is mounted to the spindle traversing platform 60 by bolts 138 (shown in FIGS. 2A and 5D) and further provided for the accurate positioning of the calibration disc 72 with the mounting disc 130. After the base portion 74 is tightly engaged to the mounting disc 130 on the spindle, a clamping means 132 that may be a C-clamp is used to fasten the base portion 74 to the mounting plate. The secure positioning of the calibration disc 72 on the mounting plate and the spindle is important such that the calibration of the centering of spindle can be accurately performed on the pedestal or on the load cup. The top surface 84 of the base portion 74 intimately engages a bottom surface 134 of the mounting disc 130 of the spindle.

The centering pin 80 and the hollow shaft 78 are further shown in FIGS. 3A and 3B. It should be noted that for simplicity reasons, the male threads 90 on the base portion 92 of the hollow shaft 78 are not shown in FIG. 3B. The male threads 90 provided on the base portion 92 of the hollow shaft 78 is used to engage female threads 94 provided in a center aperture 96 on the bottom surface 98 of the calibration disc 72. While other mechanical engagement means between the hollow shaft 78 and the top portion 76 of the calibration disc 74 may also be utilized, the bolt/thread engagement provided in the preferred embodiment can be advantageously used with high accuracy and repeatability.

The centering pin 80 is used to slidingly engage an elongated cavity 100 in the hollow shaft 78. As shown in FIGS. 3A and 3B, a suitable length for the centering pin 80 may be approximately 51 mm with a diameter of approximately 4.5 mm, while a total length of the hollow shaft may be 50 mm with a diameter of the elongated cavity 100 approximately 7.5 mm. A clearance is provided between the outside diameter of the centering pin 80 and the inside diameter of the elongated cavity 100 to allow the pin to slide freely inside the cavity. A tip portion 102 of the centering pin 80 protrudes outside the elongated cavity 100 and is locked in position by the locking device 82, i.e., a set screw. The length of the protruded portion 102 may be suitably adjusted for each calibration process which may require a different length.

Figure 4A:
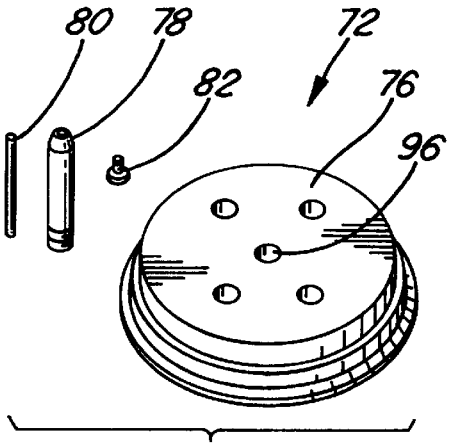
FIG. 4A is a perspective view of the present invention calibration disc, the hollow shaft, the pin and the locking device.
Figure 4B:
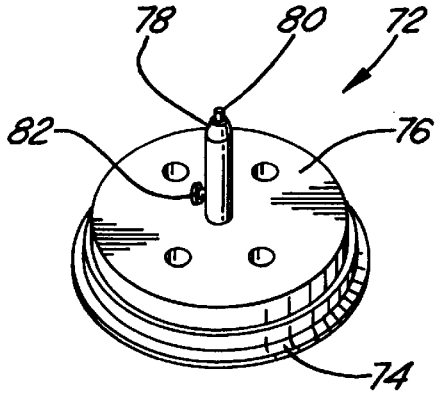
FIG. 4B is a perspective view of the calibration disc, the hollow shaft, the pin and the locking device in an assembled state.

FIGS. 4A and 4B illustrate the present invention calibration disc 72 in perspective views. FIG. 4A shows the components of the present invention calibration disc 72, while FIG. 4B illustrates the present invention calibration disc 72 after the hollow shaft 78, the centering pin 80 and the locking device 82 are assembled to the top portion 76 and the base portion 74 of the disc.

Figure 5A:
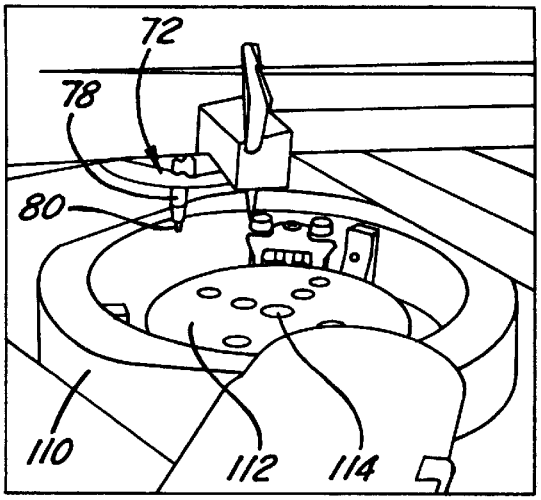
FIG. 5A is a perspective view of the present invention calibration disc mounted to a spindle in a withdrawn position.
Figure 5B:
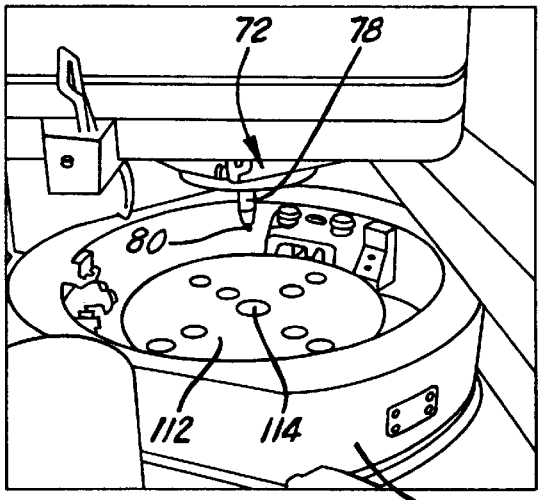
FIG. 5B is a perspective view of the present invention calibration disc mounted to a spindle with the disc positioned over the load cup and the pedestal.
Figure 5C:
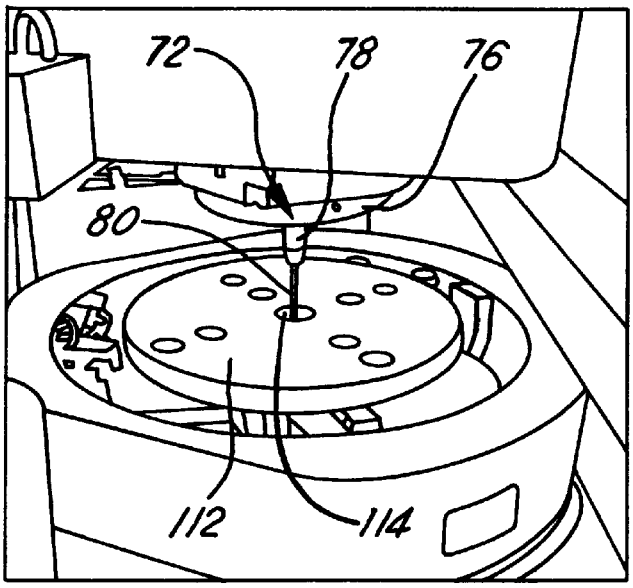
FIG. 5C is a perspective view of the present invention calibration disc with the centering pin penetrating the center alignment aperture in the pedestal during a calibration procedure.
Figure 5D:
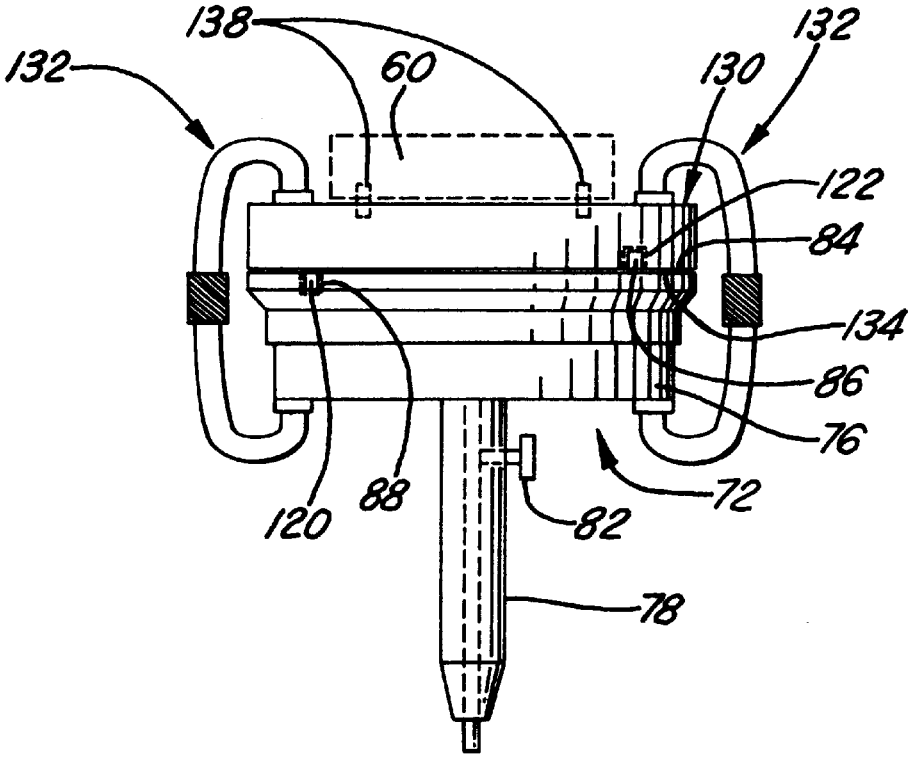
FIG. 5D is a cross-sectional view of the present invention calibration is a mounted to a mounting disc on a spindle traversing platform.

The present invention calibration disc 72 can be advantageously used in a calibration method as illustrated in FIGS. 5A, 5B and 5C. As shown in FIG. 5A, the calibration disc 72 is first mounted to a traversing platform (not shown) on the spindle mount (not shown) with the centering pin 80 pointed downwardly and positioned by a locking device (now shown). This is performed with the traversing platform 60 (shown in FIG. 2A) in a withdrawn position such that the mounting can be easier performed without the load cup 110 in the way. In the load cup 110, a pedestal 112 and a center alignment aperture 114 are shown. The center alignment aperture 114 is used for alignment of the spindle to the load cup 110. After the calibration disc 72 is properly mounted into the traversing platform 60 by utilizing the locating pin 86 and the locating aperture 88 (shown in FIG. 3), the traversing platform is moved into position directly over the pedestal 112. This is shown in FIG. 5B. The positioning of the calibration disc is predetermined in the previous operation of the polishing apparatus. The spindle, with the calibration disc 72 mounted thereon, is then lowered onto the pedestal 112 to determine the alignment of the centering pin 80 with the center alignment aperture 114. When the pin 80 and the aperture 114 do not coincide together, the position of the calibration disc 72 is adjusted by changing the X, Y parameters in a process controller to new coordinates such that the calibration procedure may be repeated. This is repeated until the centering pin 80 on the calibration disc 72 and the center alignment aperture 114 on the pedestal plate 112 coincide together perfectly.

The present invention novel apparatus of a calibration disc therefore can be advantageously used in a simple manner for the accurate calibration of a polishing head, by calibrating the spindle mounting platform that the head is mounted to with a pedestal in a load cup of a chemical mechanical polishing apparatus. It should be noted that the novel apparatus can be used in any type of polishing machines that utilizes either a single or a multiple number of polishing heads. The present invention novel apparatus and method have therefore been amply described in the above descriptions and in the appended drawings of FIGS. 3–5C. It should be emphasized that not only the position in the circumferential direction, which is controlled by the X, Y parameters of the polishing head, may be calibrated, the sweep direction (or the radial direction, or the Z direction) in which the spindle traverses the platform in a linear motion may also be calibrated by using the present invention novel apparatus and method.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows:

1. An apparatus for calibrating the centering of polishing heads in a chemical mechanical polishing (CMP) machine equipped with a plurality of spindles for mounting said polishing heads comprising:

a circular disc having top and bottom parallel planar surfaces, a hollow shaft having an elongated cavity therein for slidingly engaging a pin through an open end of the cavity, said hollow shaft having external male threads at one end for engaging female threads in a center aperture on said bottom surface of the disc, a pin for slidingly engaging said elongated cavity in said hollow shaft such that said pin extends out of or retracts into said hollow shaft, and a locking means for locking position of said pin in said elongated cavity.

2. An apparatus for calibrating the centering of polishing heads in a CMP machine equipped with a plurality of spindles for mounting said polishing heads according to claim 1, wherein said plurality of spindles comprises four spindles.

3. An apparatus for calibrating the centering of polishing heads in a CMP machine equipped with a plurality of spindles for mounting said polishing heads according to claim 1, wherein said pin being adapted for penetrating a center alignment aperture in a pedestal positioned under said spindle such that the X, Y parameters of said spindle are adjusted for calibrating the centering.

4. An apparatus for calibrating the centering of polishing heads in a CMP machine equipped with a plurality of spindles for mounting said polishing heads according to claim 1 further comprising a mounting means for removably mounting said circular disc to said spindle with said center pinpointed downwardly.

5. An apparatus for calibrating the centering of polishing heads in a CMP machine equipped with a plurality of spindles for mounting said polishing heads according to claim 4, wherein said mounting means further comprising:

a locating means for aligning said circular disc to said spindle, and a clamping means for removably mounting said circular disc to said spindle.

6. An apparatus for calibrating the centering of polishing heads in a CMP machine equipped with a plurality of spindles for mounting said polishing heads according to claim 1, wherein said pin being adapted for penetrating a center alignment aperture in a pedestal positioned under said spindle.

7. An apparatus for calibrating the centering of polishing heads in a polishing machine equipped with a plurality of spindles for mounting said polishing heads comprising:

a calibration disc having top and bottom parallel planar surfaces, said bottom surface being equipped with a pin at its center projecting away from and perpendicular to said planar bottom surface, said center pin being adapted for aligning a spindle on which the calibration disc is mounted with a center alignment aperture in a pedestal generally positioned below said spindle, and a mounting means for removably mounting said calibration disc to said spindle with said center pin pointed downwardly.

8. An apparatus for calibrating the centering of polishing heads in a polishing machine equipped with a plurality of spindles for mounting said polishing heads according to claim 7, wherein said pin at the center of the bottom surface further comprises:

a hollow shaft having an elongated cavity therein for sliding engagement with a pin through an open end of said elongated cavity, said hollow shaft having external male threads at one end for engaging an aperture having matching female threads at a center of said bottom surface, a pin for sliding engagement with said elongated cavity in said hollow shaft such that said pin extends out of or retracts into said hollow shaft, and a locking means for locking position of said pin in said elongated cavity.

9. An apparatus for calibrating the center of polishing heads in a polishing machine equipped with a plurality of spindles for mounting said polishing heads according to claim 7, wherein said mounting means for mounting said calibration disc to one of said plurality of spindles further comprising locating means for said disc and said spindle.

10. An apparatus for calibrating the centering of polishing heads in a polishing machine equipped with a plurality of spindles for mounting said polishing heads according to claim 7, wherein said mounting means comprises at least one C-clamp for clamping said disc to one of said plurality of spindles.

11. An apparatus for calibrating the centering of polishing heads in a polishing machine equipped with a plurality of spindles for mounting said polishing heads according to claim 7, wherein said calibration disc is in a circular shape.

12. An apparatus for calibrating the centering of polishing heads in a polishing machine equipped with a plurality of spindles for mounting said polishing heads according to claim 7, wherein said calibration disc is in a square shape.

13. An apparatus for calibrating the centering of polishing heads in a polishing machine equipped with a plurality of spindles for mounting said polishing heads according to claim 7, wherein said pin is adapted to align a spindle on which the calibration disc is mounted with a center alignment aperture in a pedestal for loading/unloading a substrate to be polished.

14. A method for calibrating the centering of polishing heads in a polishing machine equipped with a plurality of spindles for mounting said polishing heads comprising the steps of:

providing a calibration disc having top and bottom parallel planar surfaces, said bottom surface being equipped with a pin at its center projecting away from and perpendicular to said planar bottom surface, said center pin being adapted for aligning a spindle on which the calibration disc is mounted with a center alignment aperture in a pedestal positioned below said spindle, mounting said calibration disc to a spindle with said center pin pointed downwardly, positioning said spindle over said pedestal positioned below said spindle, aligning said center pin on said calibration disc to said center alignment aperture in said pedestal, and adjusting X and Y axis of said spindle until said center pin on said calibration disc coincides with said center alignment aperture in said pedestal.

15. A method for calibrating the centering of polishing heads in a polishing machine equipped with a plurality of spindles for mounting said polishing heads according to claim 14, wherein said step of providing a pin at the center of the bottom surface further comprising the steps of:

providing a hollow shaft having an elongated cavity therein for sliding engagement with a pin through an opening end of said elongated cavity, said hollow shaft having external male threads at one end for engaging an aperture having matching female threads at a center of said bottom surface, providing a pin for sliding engagement with said elongated cavity in said hollow shaft such that said pin extends out of or retracts into said hollow shaft, and providing a locking means for locking a position of said pin in said elongated cavity.

16. A method for calibrating the centering of polishing heads in a polishing machine equipped with a plurality of spindles for mounting said polishing heads according to claim 14, wherein said step of providing said mounting means further comprising:

providing a locating means for the precise positioning of said calibration disc to one of said plurality of spindles, and providing a C-clamp for clamping said disc to one of said plurality of spindles.

17. A method for calibrating the centering of polishing heads in a polishing machine equipped with a plurality of spindles for mounting said polishing heads according to claim 14 further comprising the step of providing said calibration disc in a circular shape.

18. A method for calibrating the centering of polishing heads in a polishing machine equipped with a plurality of spindles for mounting said polishing heads according to claim 14 further comprising the step of providing four spindles for said plurality of spindles, and rotating 90° such that a second spindle is calibrated by the same steps.

19. A method for calibrating the centering of polishing heads in a polishing machine equipped with a plurality of spindles for mounting said polishing heads according to claim 14, wherein the method is used for calibrating the centering of polishing heads in a chemical mechanical polishing machine.

20. A method for calibrating the centering of polishing heads in a polishing machine equipped with a plurality of spindles for mounting said polishing heads according to claim 15 further comprising the step of locking said pin at a length sufficient to penetrate said center alignment aperture in said pedestal.

* * * * *